US007578507B2

(12) United States Patent
Slappay

(10) Patent No.: US 7,578,507 B2
(45) Date of Patent: Aug. 25, 2009

(54) CARD TABLE, CARD TABLE TOPPER AND CARD SERVING TRACK

(76) Inventor: Robert Slappay, 238 Rockaway Tpke, Cedarhurst, NY (US) 11516

( * ) Notice: Subject to any disclaimer, the term of this patent is extended or adjusted under 35 U.S.C. 154(b) by 135 days.

(21) Appl. No.: 11/522,163

(22) Filed: Sep. 15, 2006

(65) Prior Publication Data

US 2008/0067749 A1 Mar. 20, 2008

(51) Int. Cl.
*A63F 3/00* (2006.01)

(52) U.S. Cl. ..... 273/309; 108/27

(58) Field of Classification Search ..... 273/274, 273/309; 108/27, 129; D21/37, 334, 338, D21/369, 397; D6/480
See application file for complete search history.

(56) References Cited

U.S. PATENT DOCUMENTS

| | | | | | |
|---|---|---|---|---|---|
| 327,722 | A | | 10/1885 | Rodgers | |
| 376,484 | A | | 1/1888 | Penney | |
| 456,698 | A | | 7/1891 | Fay | |
| 1,304,540 | A | * | 5/1919 | Burrowes | 273/309 |
| 1,655,512 | A | * | 1/1928 | Russell | 108/27 |
| 1,854,129 | A | * | 4/1932 | Folsom | 108/64 |
| 2,013,135 | A | * | 9/1935 | Corduan | 108/158.13 |
| 2,418,514 | A | * | 4/1947 | Lamberson | 273/309 |
| 2,555,547 | A | * | 6/1951 | Kelleghan | 108/97 |
| D167,739 | S | * | 9/1952 | Carr | D6/480 |
| 2,981,579 | A | * | 4/1961 | Shwayder et al. | 108/27 |
| 2,981,580 | A | * | 4/1961 | Hansen | 108/27 |
| 3,606,508 | A | * | 9/1971 | Burnes | 312/140.3 |
| 4,006,905 | A | | 2/1977 | Marbury | |
| 4,088,081 | A | * | 5/1978 | D'Arca | 108/27 |
| 4,153,230 | A | * | 5/1979 | Giacin | 248/345.1 |
| 5,688,126 | A | * | 11/1997 | Merritt | 434/128 |
| D420,748 | S | * | 2/2000 | Strickland et al. | D24/234 |
| 6,378,831 | B1 | * | 4/2002 | Copeland, Jr. | 248/345.1 |
| 6,671,904 | B2 | * | 1/2004 | Easterling | 5/601 |
| 2005/0218600 | A1 | | 10/2005 | Teckmeyer | |

* cited by examiner

*Primary Examiner*—William M. Pierce
(74) *Attorney, Agent, or Firm*—Richard L. Straus, Esq.

(57) ABSTRACT

A card table, card table topper and card serving segments are disclosed which facilitate the removal of cards placed on a card table. The card table and table topper include a card server track which, in certain preferred embodiments, includes an elevated surface which lifts a card from the top surface of a card table as the card is drawn towards an inner face of the track. Thereafter, an abrupt declination of an outer face of the track exposes edges of the card thereby facilitating lifting and/or removing the card from the table. Alternate preferred embodiments include a card server comprised of a groove wherein cards drawn across the groove are easily grasped for identification or removal from the table. Card server segments are also disclosed wherein each segment includes a right end, a left end, an inner face, outer face and a maximum height adjacent to the outer face. The segments are configured as straight segments, curved segments and combination straight/curved segments and can be affixed, one to another, so as to form card server tracks which also facilitate the lifting (for identification) or complete removal of a card drawn across the track from the top surface of a table upon which the card is placed.

37 Claims, 11 Drawing Sheets

CARD TABLE, CARD TABLE TOPPER AND CARD SERVING TRACK

TECHNICAL FIELD

The present invention relates to the art of playing card tables. More specifically, the present invention relates the field of card table construction and configuration.

BACKGROUND OF THE ART

Various playing card games such as, for example, poker, twenty-one and black jack are commonly played on gaming tables. Such tables often have felt or other fabric covered surfaces designed to facilitate dealing and handling of cards placed thereupon. Such surfaces may also include designs printed or otherwise applied thereto indicating areas for bet and card placement as well as the positions of the dealer and player(s).

In many playing card games, some, or all of a players cards must remain hidden in order to each player to maintain a strategic advantage. Disclosure of the identity of any or all of a players cards to another player or the dealer could detrimentally effect the player's chance of winning a hand. However, at the same time, a player must, of course, be able to view his or her own cards. Often, cards dealt to a player are discretely viewed by that player, one by one. However, despite felt, velour or other card table surface covers and/or treatments, quickly and discretely lifting a card from a tables surface may be difficult. Gaming tables of the past have not heretofore provided any significant assistance to a player attempting to so discretely lift his card(s) from the table surface—either to momentarily view the card or to lift it completely off the table and into the player's "hand"—.

It would be highly advantageous if a gaming table were disclosed which provided a means to assist a card player in quickly and easily removing a playing card from the table's surface. It would also be highly advantageous if a gaming table topper were developed that was especially designed, configured for placement upon a table so as to provide a surface with a configuration especially adapted to assist a player in removing a card from a gaming table.

SUMMARY OF THE INVENTION

Now in accordance with the present invention, a playing card table is disclosed which his especially designed, configured and adapted to assist a card player in easily and discretely viewing and/or removing a card from the surface of a table upon which it is dealt. The card table of the present invention is comprised of a table top having a top surface, a bottom surface and side walls extending between the outer edges of the top and bottom surfaces. The card table further includes a card server track positioned on the top surface and at least one supporting member affixed to and extending from the table top. The table top may be shaped and configured in a square, rectangular, oval, circular or any other desired shape.

As discussed above, at least one support member is affixed to and extends from the table top in order to provide support thereto. In embodiments of the present invention utilizing one support member, such member may be advantageously selected to be, for example, a central steel pole affixed to the bottom surface of the table top via bolts, screws or other durable fasteners. However, it is preferred that the table top be supported by at least three, and, more preferably, four support means. Such support means may be configured as, for example, conventional table legs fabricated from steel, wood, plastic or composite material.

In a first preferred embodiment of the present invention, the top surface of the table top includes a raised (elevated) track-like contour—a card server track—extending upward from the top surface of the top. As discussed in more detail below, the track includes an innermost extent adjacent to and facing the inside area of the table top as well as an outer face adjacent to the peripheral portion of the table top.

In certain preferred embodiments, it is preferred that the card server track be configured to run approximately parallel to the outer edges of the table top. The innermost extent and aspect of the card server track—that portion of the track closest to the center of the table top is referred to herein, and throughout the claims as the inner face of the track. The inner face of the track constitutes the thinnest portion of the track—having the most diminutive height—and rises very gently upward, away from the top surface of the table with a modest lift angle—what may be best described, in certain embodiments of the present invention, as a gentle chamfer—. The lift angle of the card server track is thus formed by the intersection of the top surface of the table and the inner face of the track. The track is advantageously configured so as to produce a lift angle of from about 5 to about 45 degrees. The height of the track increases from its most diminutive dimension at the inner face of the track, to a maximum height adjacent to the outermost aspect of the track. Thus, as the width of the track is traversed, from the inner face to the outermost aspect thereof, the height of the track relative to the top surface of the table increases. It is preferred that the height of the track increase from a minimum height at the inner face to a maximum height of from about ⅛ to ⅜ inches adjacent to the outer face of the track.

The outermost aspect and extent of the card server track facing the outer perimeter of the table top and the side walls thereof is referred to herein and throughout the claims as the outer face of the track. The distance between the inner face and outer face of the track is defined as track width. As mentioned above, the outer face exhibits maximum height (elevation above the surface of the remainder of the top surface of the table). The outer face may be configured as a flat planar surface that extends downward, from the maximum height of the track, to the top surface of the table. In such configurations, it is preferred that the outer face of the track is disposed at an angle of from about 60 to about 90 degrees in regard to the bottom surface of the track as well as the top surface of the table. Such an angular relationship, as described above, exposes edges of a card drawn outward, over the outer face, to be easily grasped. The outer face of the track may also be configured as a curved plane—a radial configuration—which, likewise, is configured as a radius of from about 60 to about 90 degrees for the same reason as discussed immediately above. More specifically, cards are dealt upon that portion of the top surface of the table within the card server track, the inner portion of the top surface of the table top. Thereafter, cards drawn by a player towards the track initially meet the track at the inner face of the track and begin to elevate due to the aforementioned lift angle formed by the intersection of the inner face of the track where the track height is minimum. As the card is further drawn across the track, towards the outer face of the track, the increasing height of the track elevates the card from about ⅛ to ⅜ inches above the height of the table (not covered by the card server track). As the card slides past the outermost extent of the track, the rather steep radial curve of the outer face of the track "serves" the card—creates a space between the elevated card and the outer portion of the top surface of the table top peripheral to the track. The card is then easily grasped for identification or removal from the table.

The above-described table top may be formed of one material, such as, for example, a wood, plastic or composite material wherein the card server track is formed as a continuous and integral part of the table top. Conversely. the card server track may also be fabricated separately from the remainder of the table and thereafter bonded, cemented, or affixed via metal, plastic or composite fasteners to the top surface of the table. The card server track, in such embodiments, may be fabricated from any suitable material such as, for example, wood, plastic, composite or metal and need not be fabricated from the same or similar material as that utilized to form the top surface of the table or any other part thereof.

A first alternative embodiment of the present invention differs from the embodiment described above in regard to utilizing a card server track configured as a groove within, rather than as an elevated contour located upon (or extending from) the top surface of the table top. In such embodiments, the card server track is likewise disposed and placed as a track running within and roughly parallel to the outside edges of the top surface of the table top. As described in greater detail below, the groove may be described as having an innermost aspect and edge (inner face) positioned towards an inner aspect of the top surface of the table top and a outermost aspect and edge (outer face) facing towards an outer aspect of the top surface of the table peripheral to the track. The distance between the inner and outer face of the groove—the width of the groove—as well as the depth of the groove is configured (also, as described in greater detail, below) to facilitate partial or complete manual removal of a playing card from the top surface of the table top. Thus, as a card is dealt upon the inner aspect of the top surface of the table top (that area of the table top surrounded by the track), it may be drawn across the surface of the table top towards the inner face of the track. As the card passes over the innermost aspect of the track, (the inner face) but before it reaches the outer aspect of the track (the outer face), an edge of the card may be easily grasped in order to partially or completely remove the card from the table. The top surface of the table top, at its junction with the inner and outer faces of the card server track is, in embodiments utilizing the aforementioned groove, a smooth junction devoid of any elevation or other contour that would impede smooth sliding of a card over the track. It is preferred that the aforementioned groove be configured to provide a width of from about ¼ to ½ inches between the inner and outer faces of the track (groove width) and from about ⅛ to about ¼ inches below the top surface of the table top in depth (groove depth).

In another aspect of the present invention, a card table topper is provided which is especially designed, configured and adapted to assist a card player in easily and discretely identifying and/or removing a card placed on the surface thereof. The card table topper of the present invention is comprised of a top surface having a card server track, a bottom surface and side wall(s) extending between outer edges of the bottom and top surfaces. The table topper is especially configured and adapted for placement on top of a table of suitable size and dimension.

The card table topper may be shaped and configured so as to properly cover and align with the top surface of any table selected for its placement upon. Therefore, the topper may be configured in a square, rectangular, oval, circular or any other desired shape that would so conform to the underlying table upon which it is to be placed.

The table topper of the present invention may be fabricated of any suitable material such as, but not limited to wood, fiberboard, plastic, rubber, felt and combinations thereof. In certain preferred embodiments of the present invention, a composite topper is selected. Use of composite materials allows: 1. A foundation/base portion of the topper to be constructed of a rigid material such as, for example, wood, fiberboard, particle board or plastic which exhibit the necessary rigidity and workability necessary to form the above described track thereupon/therewithin as well as the ability to be formed into a definite shape approximating the shape and dimensions of the table selected for placement of the topper; 2. A top playing surface fabricated of, for example, a fabric such as, for example a natural, synthetic or combination natural/synthetic felt or rubber mat material; and 3. A bottom surface which ordinarily is placed directly upon a supporting selected table fabricated from a non-slip material such as a rubber—including foam rubber material—.

In a first preferred embodiment of the table topper of the present invention, the top surface of the table topper is especially configured and adapted to demonstrate a raised (elevated above the plane of the top surface of the topper) track-like contour as the card server track. In certain preferred embodiments thereof, the card server track runs roughly parallel to the edges of the table topper. The innermost extent and aspect of the card server track closest to the inside portion of top surface of the table topper (the inner face of the track) exhibits the most diminutive height of the track. Thereafter as the width (the distance between the inner face and outer face) of the track is traversed, the height of the track rises gently upward with what is referred to herein as a "lift angle." The minimal thickness of the inner face of the track and the modest increase in elevation thereafter, in certain preferred embodiments, forms what may be described as a gentle chamfer.

It is highly advantageous to configure the track so as to form a lift angle of from about 5 to about 45 degrees at the intersection of the inner face thereof with the inner top surface of the topper. As the width of the track is traversed towards the outer face thereof, the height of the track reaches a maximum value. The outermost aspect and extent of the card server track (the outer face) facing the side walls of the topper thus descends, from a maximum track height, to the level of the top surface of the topper there below.

The outermost aspect and extent of the card server track facing the outer perimeter of the table topper and the side walls thereof is referred to herein and throughout the claims as the outer face of the track. The distance between the inner face and outer face of the track is defined as track width. As mentioned above, the outer face exhibits maximum height (elevation above the surface of the remainder of the top surface of the table). It is preferred that this maximum height be from about ⅛ to about ⅜ inches (above the plane of the top surface of the topper from which the track is based and extends). The outer face may be configured as a flat planar surface that extends downward, from the maximum height of the track, to the top surface of the table topper. In such configurations, it is preferred that the outer face of the track is disposed at an angle of from about 60 to about 90 degrees in regard to the bottom surface of the track as well as the top surface of the table topper. Such an angular relationship, as described above, exposes edges of a card drawn outward, over the outer face, to be easily grasped. The outer face of the track may also be configured as a curved plane—a radial configuration—which, likewise, is configured as a radius of from about 60 to about 90 degrees for the same reason as discussed immediately above. More specifically, cards are dealt upon that portion of the top surface of the table within the card server track, the inner portion of the top surface of the table topper. Thereafter, cards drawn by a player towards the track initially meet the track at the inner face of the track and begin to elevate due to the aforementioned lift angle formed by the intersection of the inner face of the track where the track height is minimum. As the card is further drawn across the track, towards the outer face of the track, the increasing height of the track elevates the card from about ⅛ to ⅜ inches above the height of the table (not covered by the card server track). As the card slides past the outermost extent of the track, the rather steep radial curve of the outer face of the track "serves" the card—creates a space between the elevated card and the outer portion of the top surface of the table topper peripheral to the track. The card is then easily grasped for identification or removal from the table.

As discussed above, the top surface of the topper may be covered with any suitable material enabling and facilitating the placement and movement of cards across the top surface such as, for example, a natural, artificial or combination natural/artificial felt material. The top surface may also be covered with a natural or artificial rubber material. Although the top surface of the topper, and the material of which it is comprised, may not demonstrate the aforementioned contour, contouring of the base portion of the topper in the dimensions and shape of the track enables the material forming the top surface of the topper—and bonded, cemented or otherwise closely adhered to the base—to assume said configuration. Close adaptation of the top surface of the topper with the contoured base portion forms the track. For example, by shaping a topper base fabricated of wood to include the aforementioned elevated track and then bonding a felt top surface thereto, the track formed in the base wood also appears in the felt.

A first alternative embodiment of the card table topper of the present invention differs from the embodiment described directly above in regard to utilizing a card server track configured as a groove within, rather than as an elevated contour located upon the top surface of the topper. In such embodiments, the card server track is likewise disposed and placed as a track running slightly within and roughly parallel to the outer edges of the top surface of the topper. As described in greater detail below, the groove may be described as having an innermost aspect and edge (inner face) facing towards an inner aspect of the topper's top surface and a outermost aspect and edge (outer face) facing towards the outer portions of the top surface of the topper peripheral to the track. The distance between these edges—the width of the groove—as well as the depth of the groove is configured (also, as described in greater detail, below) to facilitate partial or complete removal of a playing card from the top surface of the table topper. It is preferred that the width of the groove, the distance from the inner to outer face thereof to be from about ¼ inch to about ½ inch and about ¼ inch in depth.

In utilizing the topper of the present invention, a card is initially dealt upon the inner aspect of the top surface of the table topper (that area of the table top surrounded by the track), drawn across the surface of the topper towards and over the inner face of the track. As the card passes over the inner face of the groove, an edge of the card is easily grasped in order to partially or completely remove the card from the table. The top surface of the table topper, at its inner and outermost junction with the card server track is, in embodiments utilizing the aforementioned groove, a smooth junction devoid of any elevation or other contour that would impede smooth sliding of a card over the track.

The groove of the first alternate embodiment of the card table topper may be formed, for example, by initially forming the groove within the base material. For example, if a plastic base material is selected, the plastic may be molded to include the above-described groove. Thereafter, a fabric top surface, such as one fabricated of felt, may be bonded to the plastic base. Close adaptation of the fabric to the plastic—especially in regard to the area prepared as a groove—enables the felt top to assume the same respective card server track. However, since the thickness of the fabric itself tends to reduce the width and depth of the track appearing on the topper's top surface, it is necessary to increase the depth and width of the track formed in the base accordingly.

The present invention also discloses a card server track system which is especially designed, configured and adapted to assist a card player in easily and discretely identifying and/or removing a card placed on the surface thereof. The track system is comprised of individual segments of contoured track configured as straight, curved and straight/curved sections. Fabrication of individual segments in the aforementioned shapes enables the segments to be jointed together—via a means of affixing one segment to another (discussed in greater detail, below) to form a track suitable for use upon tables of various shapes and sizes.

Each of the track segments can be described as having a top surface, bottom surface, inner face, outer face, left end and right end. The width of each segment is the distance from the inner face to the outer face of the segment. The height of the segment is the distance from the top surface to the bottom surface of each segment.

As mentioned above, the card server track system includes a means for affixing the segments to one another in order to form a continuous track or, in certain embodiments, a series of segments in any desired shape. In certain preferred embodiments, the segments may be affixed to one another via affixing the left end of a segment to the right end of an adjacent segment. For example, left and right ends of the segments may advantageously include at least two assembly pin receiving holes for receipt of engagement pins utilized to attach the segments to each other at their right and left ends. Alternatively, the left (or right) ends of the segments may include contoured "key" extensions—such as, for example, "dovetail" shaped extensions—extending therefrom which matingly engage keyway slots formed in the right (or left) segment ends. Furthermore, the segments may be affixed in a non-continuous series or as a continuous track by simply affixing each segment to the top surface of a table upon which they will be used is positions so as to form the desired track or series.

The segments of the present invention may advantageously demonstrate a maximum height (also, equally referred to as thickness),—a distance between the top surface and bottom surface thereof of from about ⅛ to about ⅜ inches adjacent to the outer face. However, regardless of the maximum height of the segments, the thickness of the segment gradually increasing from a minimum at the inner face thereof to a maximum adjacent to the outer face. The segments are positioned for use with their inner face oriented towards the inner portion of a table surface upon which they are placed and their outer face towards the outer edges of the table (and peripheral to a track formed by the segments) The minimum height of the segments, at the inner face thereof, and gradual increase in height as one traverses the width of the segment (from inner face to outer face) provides a gently "lift angle". It is preferred that this lift angle, the angle at which the inner face is disposed to the top surface of the table upon which it is placed, be from about 5 to about 45 degrees. It is highly advantageous to configure the inner face of the segments so as to form a gentle chamfer-like junction with the top surface of a table upon which it is placed.

The outermost aspect and extent of the segments which are positioned upon a table surface facing the outer perimeter of the table. This outermost aspect of the segment is, as discussed above, referred to as the outer face. The distance between the inner face and outer face is segment width. As mentioned above, the outer face exhibits maximum height (elevation above the surface of the remainder of the top surface of the table). It is preferred that this maximum height be from about ⅛ to about ⅜ inches (above the plane of the top surface of the topper from which the track is based and extends). The outer face may be configured as a flat planar surface that extends downward, from the maximum height of the segment, to the top surface of the table upon which the segment is placed. In such configurations, it is preferred that the outer face is disposed at an angle of from about 60 to about 90 degrees in regard to the bottom surface of the segment as well as the top surface of the table upon which it is placed. Such an angular relationship, as described above, exposes edges of a card drawn outward, over the outer face, to be easily grasped. The outer face of the segment may also be configured as a curved plane—a radial configuration—which, likewise, is configured as a radius of from about 60 to about 90 degrees for the same reason as discussed immediately above. More specifically, cards are dealt upon that portion of the top surface of the table within, for example, a card server track formed by a series of segments—the inner portion of the top surface of the table upon which the segments are positioned. Thereafter, cards drawn by a player towards the segment track initially meet the track at the inner face of the track and begin to elevate due to the aforementioned lift angle formed by the intersection of the inner face of each segment where the segment height is minimum. As the card is further drawn across the segment, towards the outer face thereof, the increasing height of the segment elevates the card—in certain preferred embodiments—from about ⅛ to ⅜ inches above the height of the table upon which the segments are positioned. As the card slides past the outermost extent of the segment, the rather steep radial curve of the outer face of the segment "serves" the card—creates a space between the elevated card and the outer portion of the top surface of the table peripheral to the track formed by the segments. The card is then easily grasped for identification or removal from the table.

As mentioned above, the segments are positioned during use, with their outer face oriented towards the outer perimeter of the table upon which they are to be utilized. Conversely the inside face of the segments are oriented towards the inner portion of the table surface. The segments are arranged, in preferred embodiments of the present invention, so as to lie within and be positioned so as to form a continuous track running within and substantially parallel to the outer edges of a table upon which they are arranged. Thus, for example, if the segments are utilized on a round table, they are generally arranged from curved segments of desired radius to form a concentric circle lying within the outer dimensions of the table upon which they are placed. If a square table is utilized, the segments may be arranged as a square, of lesser dimensions than that of the table, lying within and roughly parallel to the edges of the table. However, it is also contemplated that the track can be placed upon only a portion of the table, proximate to that portion of the table where cards may be dealt and read.

DETAILED DESCRIPTION

Figure 1A:
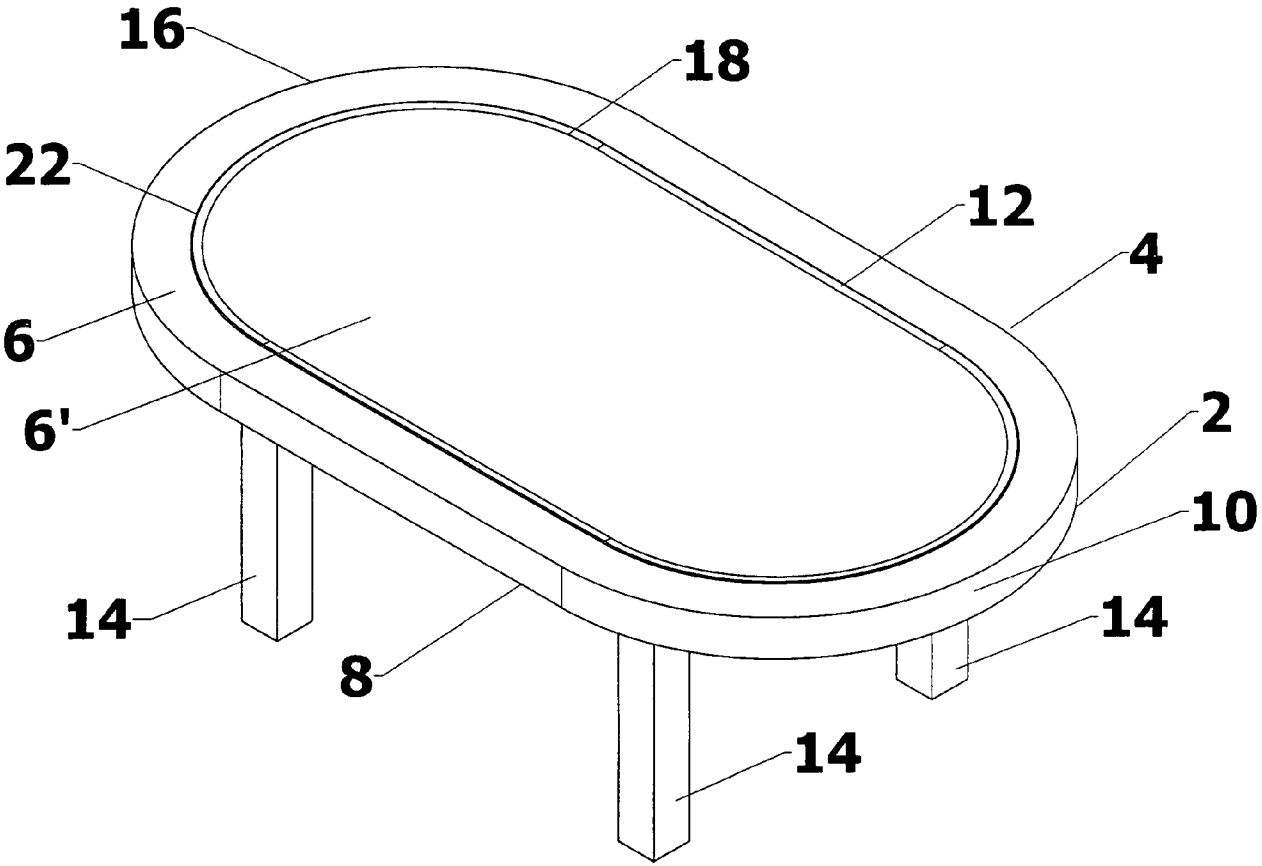
FIG. 1*a* illustrates a preferred embodiment of the card table of the present invention wherein the card server track is configured as a raised contour.
Figure 1B:
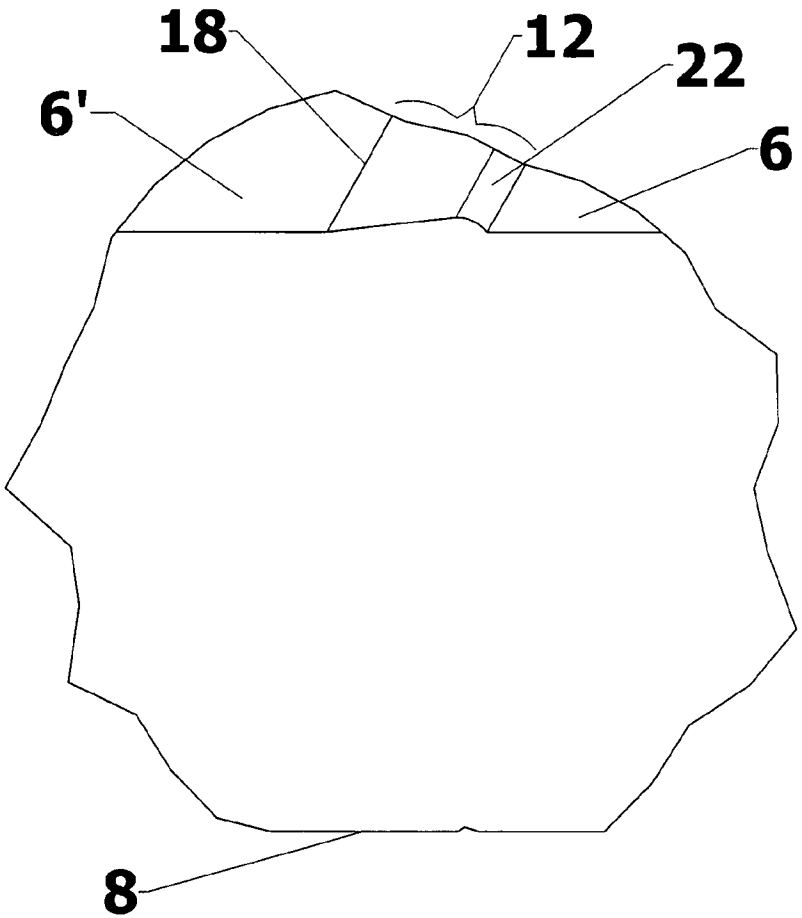
FIG. 1*b* illustrates a detailed view of a portion of the embodiment shown in FIG. 1*a*.
Figure 1C:
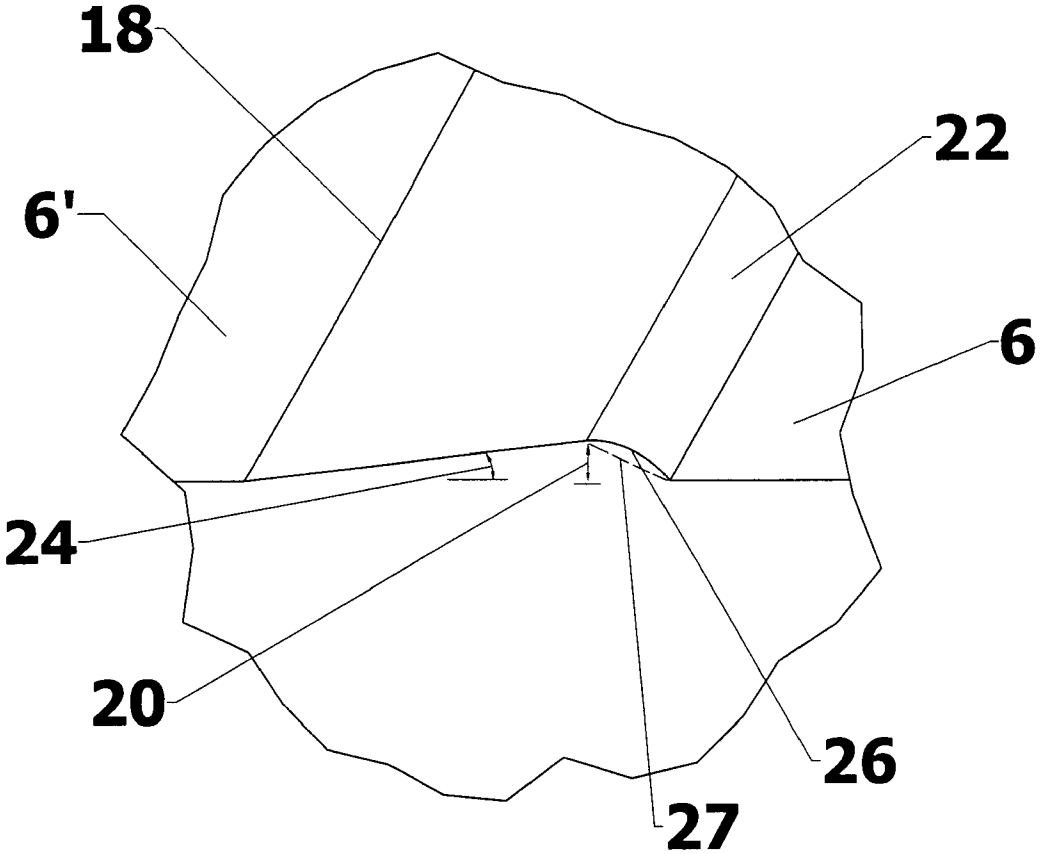
FIG. 1*c* illustrates another detailed view of a portion of the embodiment shown in FIG. 1*a*.

In a first preferred embodiment of the present invention illustrated in FIGS. 1*a*, 1*b* and 1*c*, the gaming table 2 is comprised of a table top 4 having a top surface 6 & 6', a bottom surface 8 and side wall(s) 10 extending between outer edges of the top and bottom surfaces and a card server track 12. Four supporting leg members 14 are affixed to and extends from the bottom surface of the table top.

As discussed above, the card table of the present invention utilizes at least one support member. In the embodiment illustrated in FIGS. 1*a*, 1*b* and 1*c*, supporting legs 14 are affixed to and extend from the bottom surface of the table top in order to provide support thereto. In embodiments of the present invention utilizing one support member, such member may be advantageously selected to be, for example, a central steel pole affixed to the bottom surface of the table top via bolts, screws or other durable fasteners. However, it is preferred that the table top be supported by at least three, and, more preferably, four support means. Such support means may be configured as, for example, conventional table legs fabricated from steel, wood, plastic or composite material.

In a first preferred embodiment of the present invention, the top surface of the table top 6 & 6'—which is, of course, a substantially flat plane—includes a raised (elevated) track-like contour 12 which serves as a card server track. The track runs roughly parallel to the outer edges 16 of the table top. The innermost extent and aspect of the card server track—that portion of the track closest to the inner portion of the top surface of the table top 6'—is referred to as the inner face of the track 18. The inner face of the track rises with a very gentle (upward) lift angle 24 which may be best described, in certain embodiments of the present invention, as a gentle chamfer. It is highly advantageous that said track be configured to demonstrate a lift angle 24 of the inner face of from about 5 to about 45 degrees. Thereafter, the height of the track increases to a maximum height 20. It is highly advantageous that the track be configured to demonstrate a maximum height be from about ⅛ to ⅜ inches.

The outermost aspect and extent of the card server track 22 facing and adjacent to the outer portion 6 of the top surface of the table top as well as the side walls thereof 10 is referred to herein as the outer face 22 of the track. The outer face of the track exhibits the maximum height of the track and meets that portion of the top surface of the table adjoining it rather abruptly with, in the embodiment illustrated herein, a radius or serving angle 26. More specifically, in certain preferred embodiments of the present invention, the outer face 22 of the track is configured as a planar—as opposed to curved—surface which descends—at a given, and preferably sharp angle (a serving angle)—from the aforementioned maximum height of the track to the planar surface of the table. In FIG. 1*c*, a flat planar outer face configuration is represented with dashed line 27. In such embodiments, it is highly advantageous to configure the track to exhibit a serving angle of from about 60 to about 90 degrees—the serving angle being the angle at which the planar outer face is disposed in regard to the bottom surface of the track as well as the top surface of the table top. However, in other preferred embodiments of the present invention it is highly advantageous to shape and configure the outer face 22 of the track as a radius, rather than as a flat plane as illustrated by radius 26. A radial configuration provides better adaptation of top coverings (such as felt, wool or rubber) to the base layer due to the elimination of sharp angles between the outer face and table top and also decreases the chance of card binding on these same sharp angles formed by the meeting of planar surfaces disposed at acute angles. If configured as a radius, it is preferred that the radius defined by the curved outer face of the track be from about 60 to about 90 degrees.

Cards dealt upon the top surface 6 of the table top within the card server track 12 drawn by a player towards the track meet the track at the aforementioned chamfer-like lift angle 24 at the inner face 18 where the track height is minimum. As the card is further drawn across the track, towards the outer face 22, the increasing height of the track elevates the card, in certain preferred embodiments, from about ⅛ to ⅜ inches above the height of the table (not covered by the card server track). As the card slides past the outermost extent of the track, the steep and abrupt service angle at which the flat planar outer face is disposed—in embodiments of table utilizing flat planar outer face 27 configurations—, or the abrupt radius 26 in embodiments utilizing a curved outer face—provides a space below the card which allows easy and discrete lifting of the card from the table surface. The track enables both total removal of the card from the table or a quick, momentary glance of the surface of the card facing downward on the table via a quick an simple bending of a corder of the card by a player.

Figure 2A:
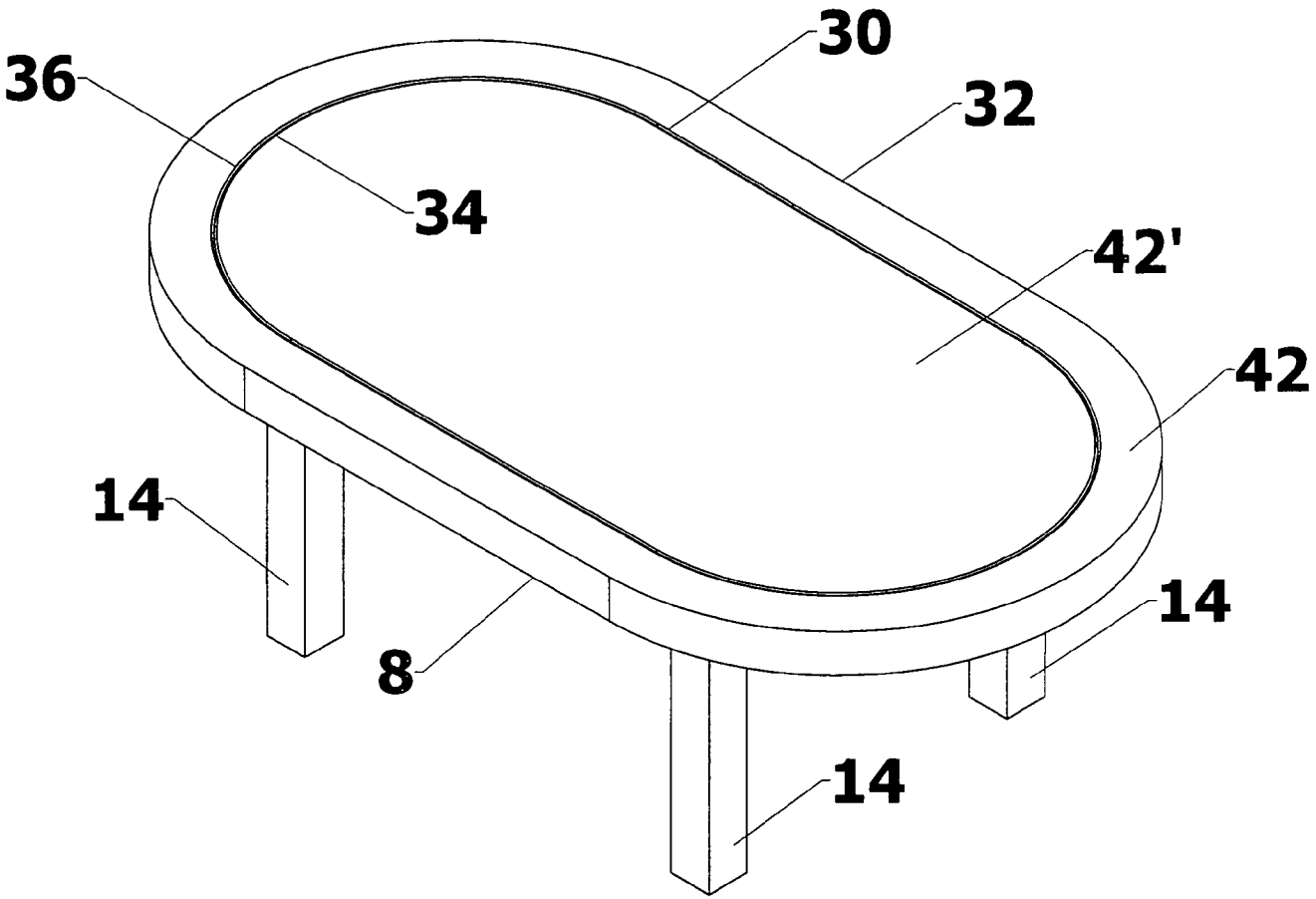
FIG. 2*a*. Illustrates a preferred embodiment of the card table of the present invention wherein the card server track is configured as a groove.
Figure 2B:
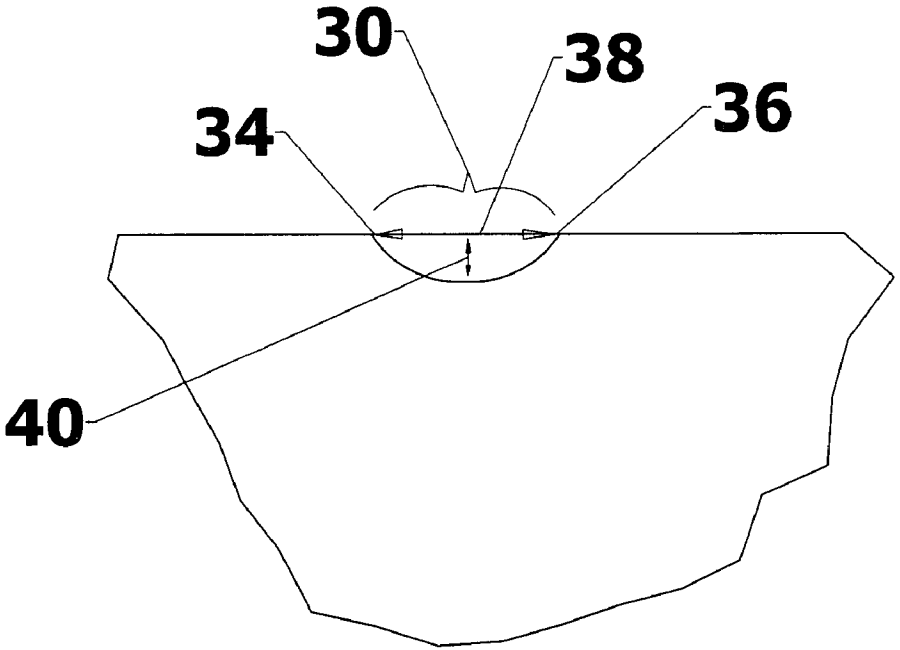
FIG. 2*b* illustrates a detailed view of a portion of the embodiment shown in FIG. 2*a*.

In a first alternative preferred card table of the present invention illustrated in FIG. 2*a* and FIG. 2*b*, the embodiment differs from that shown and described above in regard to FIG. 1 in that the first alternative card table of the present invention utilizes a card server track 30 configured as a groove within, rather than as an elevated contour located upon (or extending from) the top surface of the table top. In such embodiments, the card server track is likewise disposed and placed as a track running slightly within and roughly parallel to the outside edges 32 of the top surface of the table top—a substantially flat plane—. As described in greater detail below, the groove may be described as having an innermost aspect and edge (inner face) 34 positioned towards an inner aspect of the top surface of the table top and a outermost aspect and edge (outer face) 36 facing towards the edges of the table. The distance between these edges—the width 38 of the groove as well as the depth of the groove 40 is configured (also, as described in greater detail, below) to facilitate partial or complete removal of a playing card from the top surface of the table top. Thus, as a card is dealt upon the inner aspect of the top surface 42' of the table top (that area of the table top surrounded by the track), it may be drawn across the surface towards the inner edge 34 of the track. As the card passes over the inner aspect of the track, but before it reaches the outer aspect of the track, an edge of the card is easily grasped in order to partially or completely remove the card from the table. The top surface of the table top, at its junction with the inner and outer faces of the card server track is, in embodiments utilizing the aforementioned groove, a smooth junction devoid of any elevation or other contour that would impede smooth sliding of a card over the track. It is preferred that the aforementioned groove 30 be configured to provide a width 38 of approximately ¼ to ½ inches between the inner and outer faces of the track (groove width) and a depth of from about ⅛ to about ¼ inches. (groove depth 40).

Figure 3A:
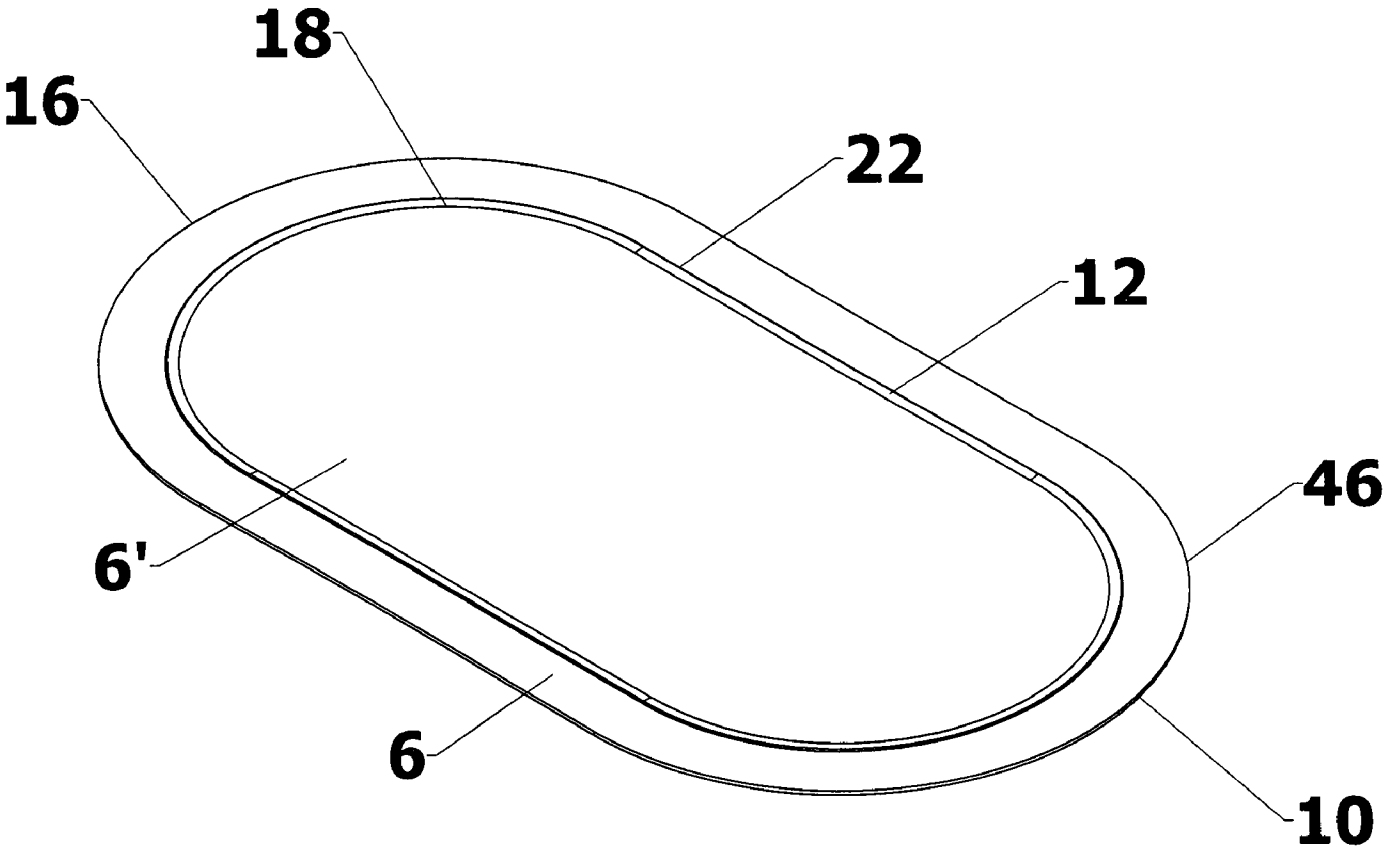
FIG. 3*a* illustrates a preferred embodiment of the card table topper of the present invention wherein the card server track is configured as a raised contour.
Figure 3B:
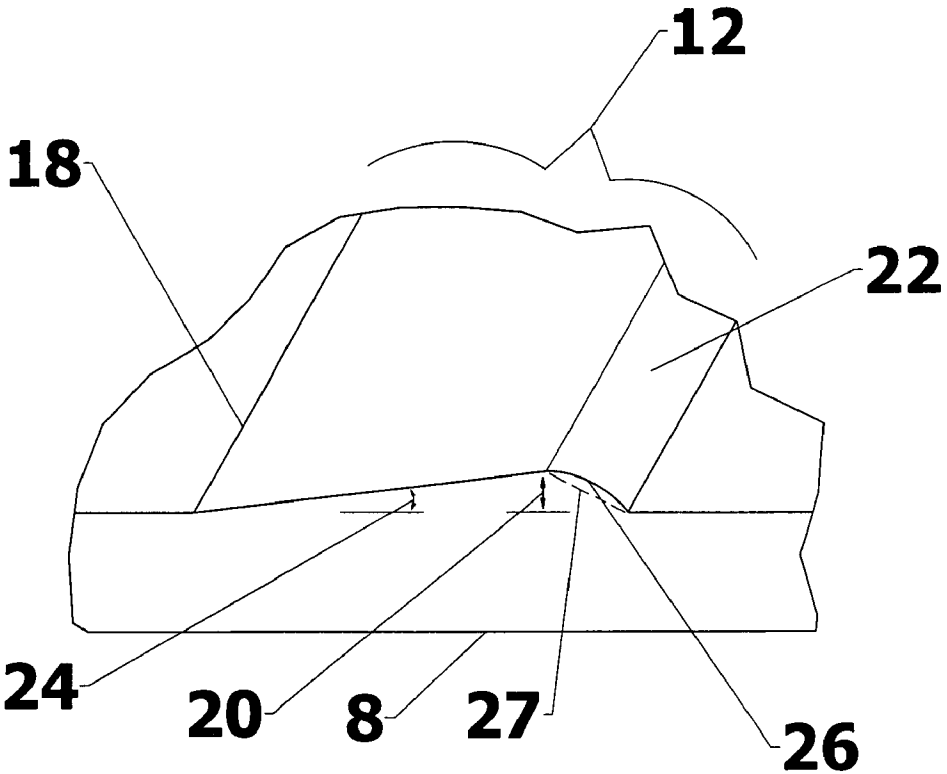
FIG. 3*b* illustrates a detailed view of a portion of the embodiment shown in FIG. 3*a*.

FIGS. 3*a* and 3*b* illustrate a card table topper 46 of the present invention. The card table topper is comprised of a flat, planar top surface 6 & 6' having a card server track 12, a bottom surface 8 and side wall(s) 10 extending between outer edges of the bottom and top surfaces. The table topper is especially configured and adapted for placement on top of a selected tables of suitable size and dimension.

The top surface 6 & 6' of the table topper shown in FIGS. 3*a* and 3*b*. is especially configured and adapted to demonstrate a raised (elevated) track-like contour as the card server track 12. The card server track runs roughly parallel to the edges 16 of the table topper. The innermost extent and aspect of the card server track closest to the center of the table (the inner face 18) topper includes a lift angle 24 which rises very gently upward with what may be best described, in certain embodiments of the present invention, as a gentle chamfer. It is highly advantageous that said track be configured to demonstrate a lift angle 24 of the inner face of from about 5 to about 45 degrees. Thereafter, the height of the track increases to a maximum height 20. It is highly advantageous that the track be configured to demonstrate a maximum height be from about ⅛ to ⅜ inches. The outermost aspect and extent of the card server track 12 facing the side walls of the table—the outer face 16 of the track—exhibits the maximum height 20 of the track and meets that portion of the top surface of the table adjoining it with a rather abrupt radius—in embodiments wherein the outer face is configured as a curved plane—or serving angle—in embodiments wherein the outer face is configured as a flat plane—

More specifically, in certain preferred embodiments of the present invention, the outer face of the track is configured as a planar (represented by dashed line 27)—as opposed to a curved—surface which descends—at a given, and preferably sharp angle (a serving angle)—from the aforementioned maximum height of the track to the planar top surface 6 of the table. In embodiments utilizing a flat planar outer face configuration, it is highly advantageous to configure the track to exhibit a serving angle of from about 60 to about 90 degrees—the angle at which the plane of the outer face is disposed in regard to the top surface of the topper 6. However, as mentioned above, in other preferred embodiments of the present invention it is highly advantageous to shape and configure the outer face 22 of the track as a radius, rather than planar. A radial configuration (as illustrated in FIG. 3*b*) provides better adaptation of top coverings (such as felt, wool or rubber) to the base layer and also decreases the chance of card binding on sharp angles formed by the meeting of planar surfaces disposed at acute angles. If configured as a curved planar surface it is preferred that the radius 26 defined by the outer face of the track be from about 60 to about 90 degrees.

Cards dealt upon the inner portion of the top surface 6' of the table top within the card server track 12, drawn by a player towards the track, meet the track at the aforementioned chamfer-like lift angle 24 at the inner face 18 where the track height is minimum. As the card is further drawn across the track, towards the outer face 22, the increasing height of the track elevates the card, in certain preferred embodiments, from about ⅛ to ⅜ inches above the height of the table (not covered by the card server track). As the card slides past the outermost extent of the track, the steep and abrupt service angle between the outer face of the track and top surface of the topper—in embodiments utilizing a flat planar outer face 27—or the abrupt radial curve 26—in embodiments utilizing a curved planar outer face—provides a space below the card which allows easy and discrete lifting of the card from the table surface. The track enables both total removal of the card from the table or a quick, momentary glance of the surface of the card facing downward on the table via a quick an simple bending of a corder of the card by a player.

As discussed above, the top surface of the topper may be covered with any suitable material enabling and facilitating the placement and movement of cards such as, for example, a felt material. Although the top surface of the topper, and the material of which it is comprised, does demonstrate the aforementioned contour, contouring of the base portion of the topper, in the dimensions and shape of the track, enables the material forming the top surface of the topper to assume said configuration—if the material forming the top is flexible and closely adapted to the base. It is this close adaptation of the top surface of the topper with the contoured base portion forms the track. For example, by shaping a topper base fabricated of wood to include the aforementioned elevated track and then bonding a felt top surface thereto, the track formed in the base wood also appears in the felt.

Figure 4A:
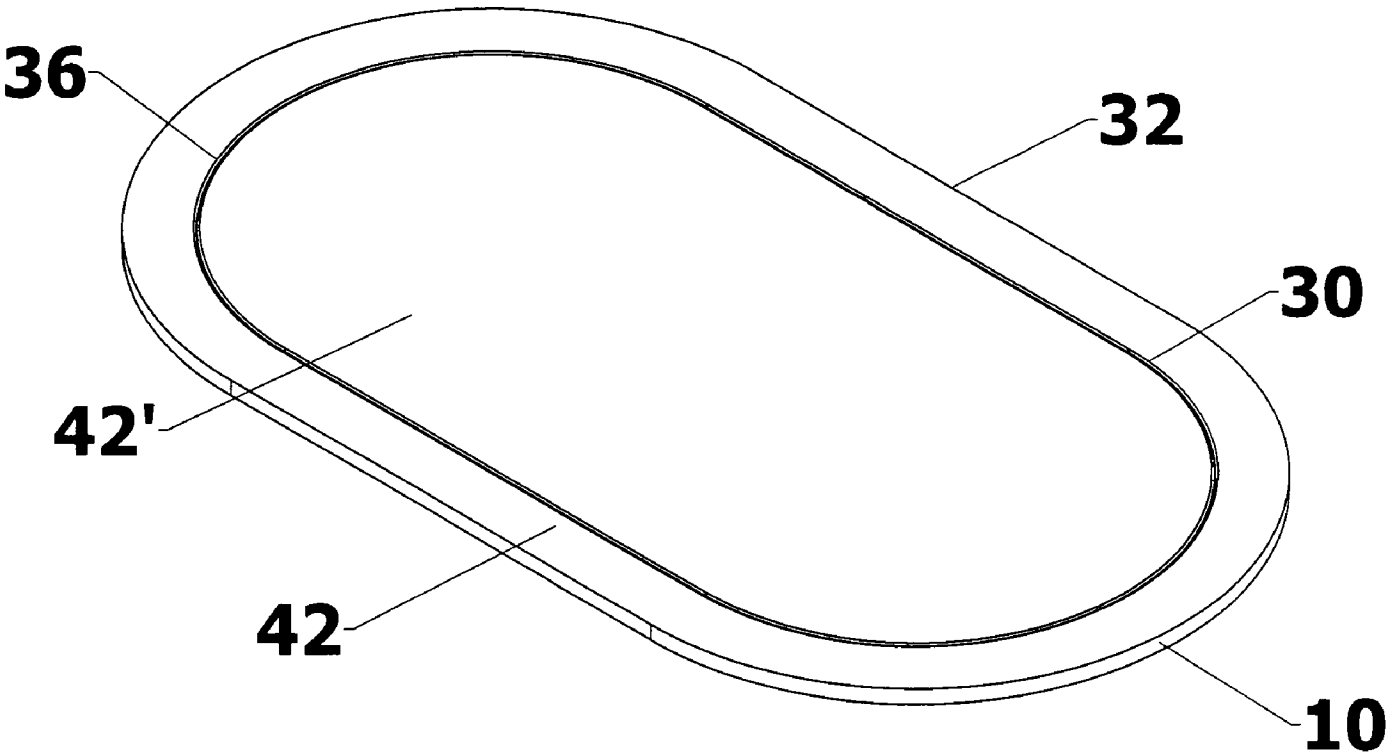
FIG. 4*a* illustrates a preferred embodiment of the card table topper of the present invention wherein the card server track is configured as a groove.
Figure 4B:
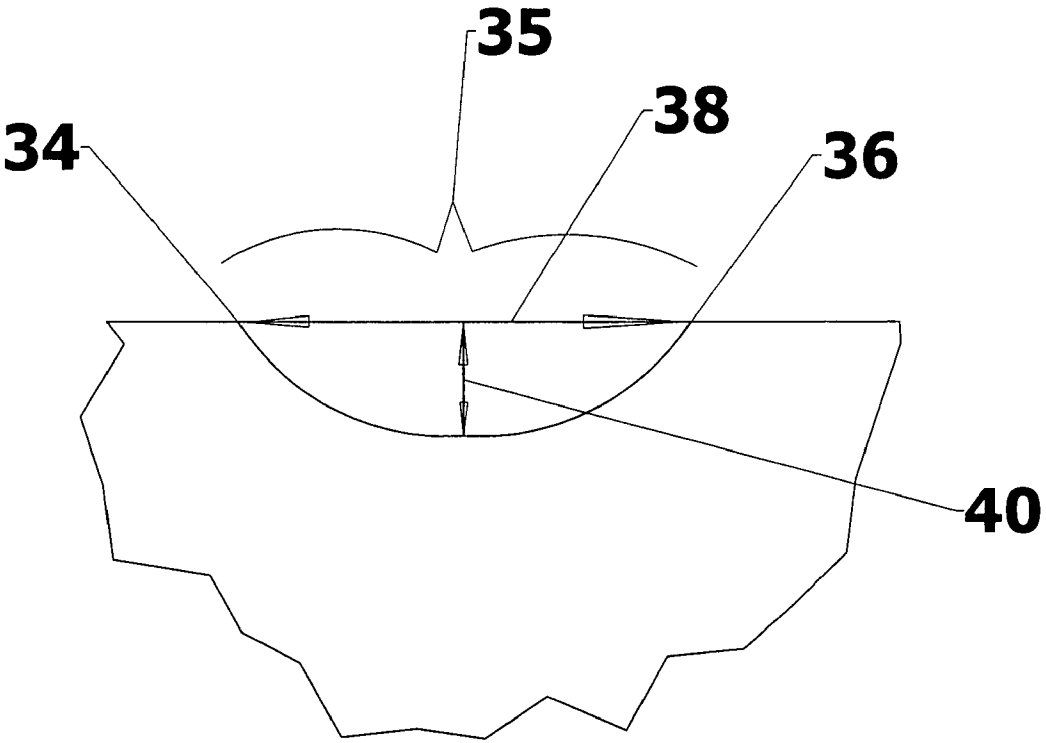
FIG. 4*b* illustrates a detailed view of a portion of the embodiment shown in FIG. 4*a*.

FIGS. 4*a* and 4*b* illustrate an alternative embodiment of the card table topper of the present invention. This embodiment differs from the embodiment described directly above (referring to FIGS. 3*a* and 3*b*) in that the embodiment shown in FIGS. 4*a* and 4*b* utilize a card server track 30 configured as a groove 35 within, rather than as an elevated contour located upon the top surface of the topper. In such embodiments, the card server track is likewise disposed and placed as a track running slightly within and roughly parallel to the edges 32 of the top surface 42 of the topper. As described in greater detail below, the groove may be described as having an innermost aspect and edge (inner face 34) facing towards an inner aspect of the top surface 42' of the table top and a outermost aspect and edge (outer face) 36 facing towards outer portion of the top surface 42 of the topper and the outside edges of the topper. The distance between the inner face and outer face of the groove is referred to as groove width 38. Groove depth 40 (represented by the line 40 intersecting and running perpendicular to the plane formed by the top surface of the topper extending to the deepest part of the groove. It is preferred that the groove be configured to demonstrate a width 38 of from about ¼ inch to about ½ inch and a depth of about ¼ inches. Thus, as a card is dealt upon the inner aspect 42' of the flat, planar top surface of the table topper (that area of the table top surrounded by the track), it is then initially drawn across the surface towards and over the inner face 34 of the track. As the card passes over the inner face, an edge of the card is easily grasped in order to partially or completely remove the card from the table. The top surface of the table topper, at its inner and outermost junction with the card server track is, in embodiments utilizing the aforementioned groove, a smooth junction devoid of any elevation or other contour that would impede smooth sliding of a card over the track.

The groove of the first alternate embodiment of the card table topper may be formed, for example, by initially forming the groove within the base material. For example, if a plastic base material is selected, the plastic may be molded to include the above-described groove. Thereafter, a fabric top surface, such as one fabricated of felt, may be bonded to the plastic base. Close adaptation of the fabric to the plastic—especially in regard to the area prepared as a groove—enables the felt top to assume the same respective card server track. However, since the thickness of the fabric itself tends to reduce the width and depth of the track appearing on the topper's top surface, it is necessary to increase the depth and width of the track formed in the base accordingly.

Figure 5A:
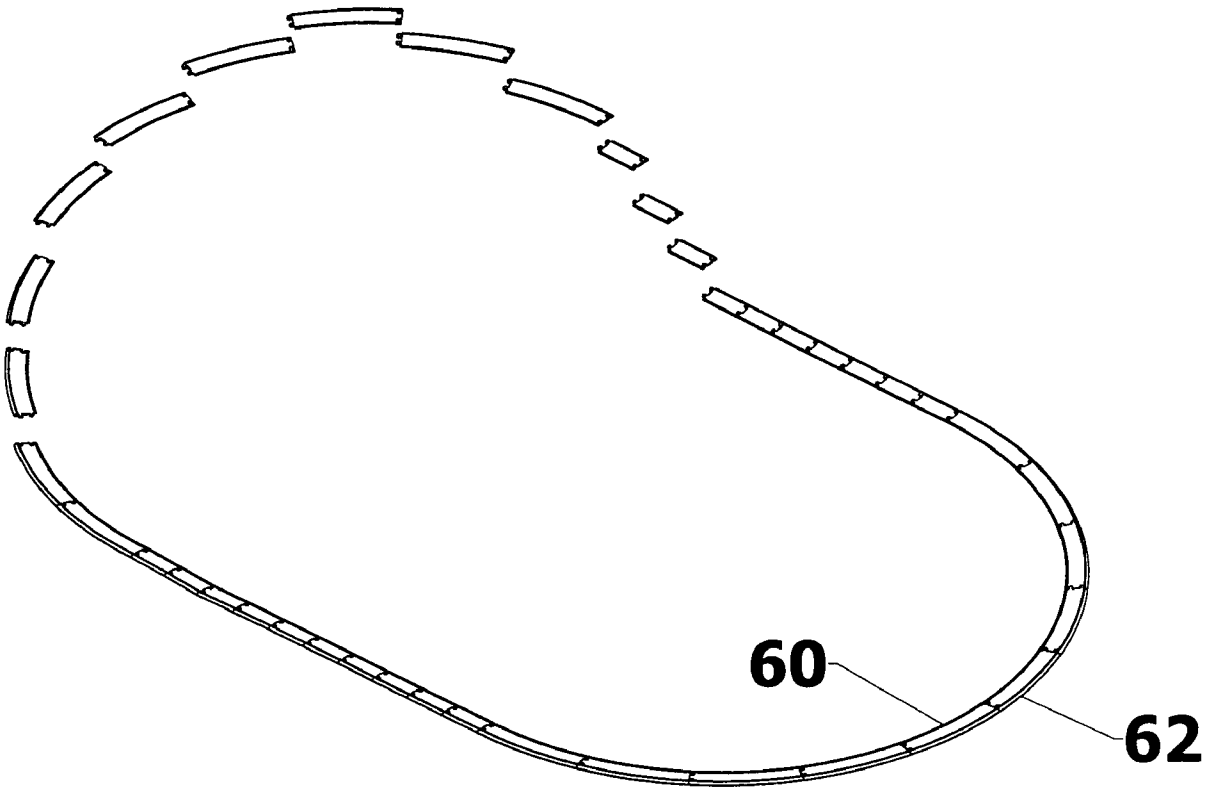
FIG. 5*a* illustrates a preferred embodiment of the track segments of the present invention.
Figure 5B:
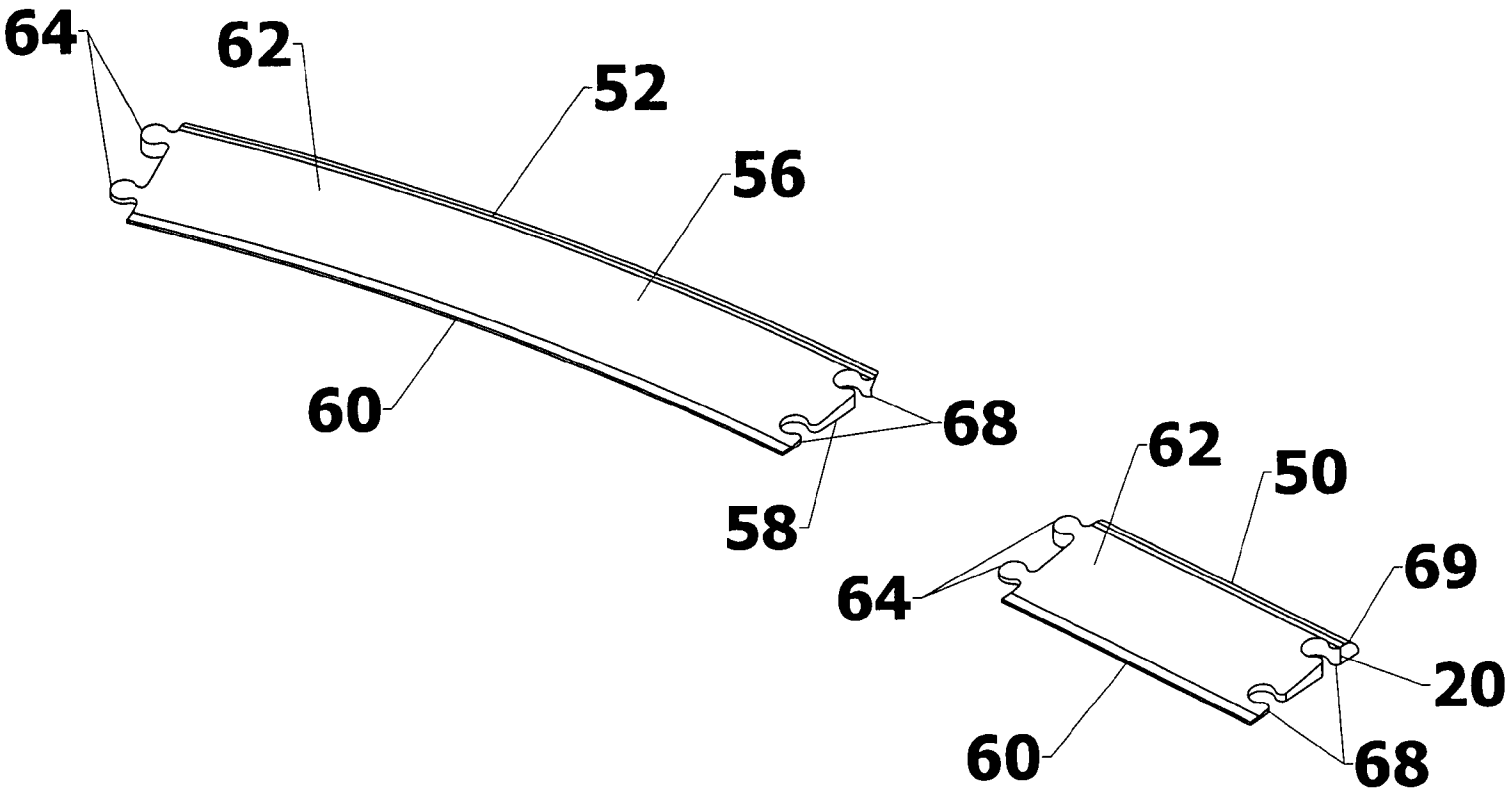
FIG. 5*b* illustrates a detailed view of a portion of the embodiment shown in FIG. 5*a*.

FIG. 5 illustrates a card server track system of the present invention. The track system is comprised of individual segments of contoured track configured as straight 50 and curved 52 sections. However, the segments may be contoured in any desired shape so as to enable conformation with a given desired track shape. Fabrication of individual segments in the aforementioned shapes enables the segments to be jointed together to form a track suitable for use upon tables of various shapes and sizes.

Each of the track segments can be described as having a top surface 56, bottom surface 58, inner face 60, outer face 52, left end and right end. The left and right ends of the segments may advantageously include at least two assembly pin receiving holes for receipt of engagement pins utilized to attach the segments to each other at their right and left ends. Alternatively, the left (or right) ends of the segments may include contoured "key" extensions 64—such as, for example, "dovetail" shaped extensions—extending therefrom which matingly engage keyway slots 68 formed in the right (or left) segment ends.

The segments of the present invention demonstrate an elevated contour extending upward from the top surface of said table top in order to facilitate the viewing and removing of playing cards placed upon a top surface of a table top upon which the segments are placed. More specifically, each of the segments utilized in the card server track system of the present invention demonstrates a maximum thickness 20 proximal to the below described outer face thereof. It is preferred that this maximum thickness,—the distance between the top surface 56 and bottom surface 58 of each segment—be from about ⅛ to ⅜ inches. In certain preferred embodiments of the track system of the present invention, each segment demonstrates a maximum thickness (or maximum height) adjacent to the outer face thereof. The height (or thickness of the segment, as it may also be referred to) gradually diminishes from the maximum value to a minimum thickness at the inner face wherein the top surface joins the lower surface of the segment and is also in close proximity with the top surface of a table upon which it is placed. At the inner face of each segment—where the height is at its most diminished value and the top surface of the segment meets the bottom surface thereof, the segment forms a fine edge and a diminutive lift angle. The lift angle is the angle at which the planar surface of the inner face is disposed in comparison to the plane formed by the top surface of the table upon which the segment is placed. In certain preferred embodiments, the inner face may be best described as meeting the top surface of a table upon which it is placed with a chamfer.

The outermost aspect and extent of the segments—ordinarily positioned upon a table facing the peripheral edges thereof is referred to as the outer face 52. The outer face of the segments exhibits the maximum segment height 20. In certain preferred embodiments of the present invention, the outer face of the segment is configured and shaped as a curved plane defining a radius 69 which descends rather abruptly from the maximum height of the segment to the planar surface of the table upon which it is placed. In embodiments of the present invention wherein the outer face of the segments are configured as curved planes, it is preferred that the radius defined thereby be from about 60 to 90 degrees so, as discussed above and below, to facilitate grasping of the edges of cards passing over the outer face. In other preferred embodiments of the present invention, the outer face of the segments are configured as flat planes forming what may be described as a "serving angle" with the planar surface of a table top upon which the segment is placed. More specifically, in these embodiments utilized a flat planar outer face, the flat plane formed by the outer face is disposed at an angle in regard to the plane of the table upon which the segment is located. It is preferred that the outer face of such embodiments be configured to provide an outer face disposed at from about 60 to about 90 degrees in regard to the table top—or, as it may also be described, provided a serving angle of from about 60 to 90 degrees—.

In contrast, the outer face of the segment is advantageously configured to demonstrate a thickness substantially equal to the maximum thickness 80 of the segment and the outer face is disposed at a substantial angle in relation to the top surface of a table upon which it is placed. Thus, in preferred embodiments of the card server track system of the present invention, the top surface and bottom surface of the segment are joined—at the outer face—by means of a wall oriented at and defining a service angle 86 of from about 60 to about 90 degrees.

The segments are positioned during use, with their outer face oriented towards the outer perimeter of the top surface of the table upon which they are to be utilized. Conversely the inside face of the segments are oriented towards the inner portion of the to surface of the supporting table. The segments are arranged, in preferred embodiments of the present invention, so as to lie within and be positioned so as to form a continuous track running within and substantially parallel to the outer edges of a table upon which they are arranged. Thus, for example, if the segments are utilized on a round table, they are generally arranged from curved segments of desired radius to from a concentric circle lying within the outer dimensions of the table upon which they are placed. If a square table is utilized, the segments may be arranged as a square, of lesser dimensions than that of the table, lying within and roughly parallel to the edges of the table. However, it is also contemplated that the track can be placed upon only a portion of the table, proximate to that portion of the table where cards may be dealt and read.

As described above, the inner face 60 of the segments, lying closest to the center of the table top upon which they are arranged, rises very gently upward with a lift angle which may be best described, in certain embodiments of the present invention, as a gentle chamfer. It is highly advantageous that the segments be configured to demonstrate a lift angle of from about 5 to about 45 degree. In contrast, the outer face 63 of the card server segments facing the outer edges of the table meets that portion of the top surface of the table upon which they are arranged with a rather steep and abrupt service angle. In certain preferred embodiments of the present invention, the outer face may be configured as a curved plane extending from the top surface of the segment downward to meet the bottom surface of the segment (as well as the top surface of a table upon which the segment is placed). In such embodiments, the outer face thus is comprised of a curved plane forming a radial curve. In preferred embodiments having a curved outer face, it is highly advantageous to configure the segments to exhibit an outer face demonstrating a radius of from about 60 to about 90 degrees. Thus, cards dealt upon the top surface of the table top within the track formed by the segments, drawn by a player towards the track formed thereby, are gently elevated by the chamfer like lift angle formed by the junction of the inner faces of the segments with a table surface upon which they are placed and continue to rise to a maximum elevation, in regard to the top surface of a card table, equal to the maximum thickness of the segment. Thereafter, further sliding of a card towards and over the outer face of the segment provides access to edges of a playing card as they pass over the aforementioned radial curve. The cards may then be easily grasped at lifted (via the accessed edges) to either momentarily view the card or completely remove the card from the table surface. Certain preferred embodiments of the present invention included segments demonstrating flat (non-curved) outer faces which form rather sharp angles with the surface of a table upon which they are placed (as well as the bottom surface of the segment itself. In such embodiments, it is preferred that outer face of each segment be configured to be disposed at an angle of from about 60 to about 90 degrees in relation to the top surface of table upon which the segments are placed (as well as the bottom surface of the segment).

The terms and expressions which have been employed in the foregoing specification and in the abstract are used therein as terms of description and not limitation, and there is no intention, in the use of such terms and expressions, of excluding equivalents of the features shown and described or portions thereof, it being recognized that the scope of the invention is defined and limited only by the following claims.

I claim:

1. A card table comprised of a table top, a card server track, and at least one supporting member affixed thereto wherein, said table top includes a flat, planar top surface, a bottom surface and side walls extending between outer edges of said top and bottom surfaces; and said card server track has a length and is shaped and configured to demonstrate an elevated contour extending upward from the top surface of said table top, the card server track being positioned and located upon the planar top surface so as to divide said planar top surface into an inner planar portion circumscribed by and located within the server track and an outer planar portion completely circumscribing and located peripheral to the server track and said outer planar portion extending to and being contiguous with the outer edges of the top surface of the table wherein the inner planar portion and outer planar portion lie upon the same plane in order to facilitate the viewing and removing of playing cards placed upon the top surface of said table top and drawn across said card server track at any point along the length thereof.

2. The card table of claim 1 wherein said table includes at least one supporting member affixed to the bottom surface of said table top.

3. The card table of claim 1 wherein said table includes three supporting members extending affixed to the bottom surface of said table top.

4. The card table of claim 1 wherein said table includes four supporting members affixed to the bottom surface of said table top.

5. The card table of claim 1 wherein said card server track includes a track width, a track height, an inner face and an outer face.

6. The card table of claim 5 wherein said track is configured to demonstrate a minimum height adjacent to the inner face and a maximum height adjacent to the outer face thereof.

7. The card table of claim 6 wherein the inner face of said card server track is disposed at an angle of from about 5 degrees to about 45 degrees in relation to the planar top surface of the table.

8. The card table of claim 6 wherein the outer face of the card server track is a flat planar surface.

9. The card table of claim 8 wherein the outer face is disposed at an angle of from about 60 to about 90 degrees in relation to the planar top surface of the table.

10. The card table of claim 6 wherein the outer face of said card server track is configured as a curved surface.

11. The card table of claim 10 wherein said curved outer face of the card server track defines a radius of from about 60 to about 90 degrees.

12. The table of claim 1 wherein the table top and track are formed of one material and wherein the track is formed as a continuous and integral part of said top.

13. The table of claim 12 wherein said table top and track are formed from a material selected from the group including wood, plastic and composite materials.

14. The table top of claim 13 wherein the top surface of said table top and the track are covered by a felt material selected from the group including natural felt, artificial felt and natural/artificial felt.

15. The table top of claim 12 wherein said top surface of the table top and track are covered with a material selected from the group comprising natural and artificial rubber materials.

16. The table of claim 1 wherein the table top and server track are separately formed and fabricated and a means is utilized to affix the server track to the top surface of the table top.

17. The table of claim 16 wherein said table top and track are formed from a material selected from the group including wood, plastic and composite materials.

18. The table top of claim 16 wherein the top surface of said table top and the track are covered by a felt material selected from the group including natural felt, artificial felt and natural/artificial felt.

19. The table top of claim 16 wherein said top surface of the table top and track are covered with a material selected from the group comprising natural and artificial rubber materials.

20. The table top of claim 16 wherein the means utilized to affix the server track to the top surface of the table top is selected from the group including bonding, cementation, metal fasteners, plastic fasteners and composite fasteners.

21. A card table topper comprising a flat, planar top surface, a bottom surface, side walls extending between outer edges of said top and bottom surfaces and a card server track wherein said server track has a length and is shaped and configured to demonstrate an elevated contour extending upward from the top surface of said topper, the card server track being positioned and located upon the planar top surface so as to divide said planar top surface into an inner planar portion circumscribed by and located within the server track and an outer planar portion completely circumscribing and located peripheral to the server track, said outer planar portion extending to and being contiguous with the outer edges of the top surface of the topper wherein the inner planar portion and outer planar portion lie upon the same plane in order to facilitate the viewing and removing of playing cards placed and drawn across said card server track at any point along the length thereof.

22. The card table topper of claim 21 wherein said card server track includes a track width, a track height, an inner face and an outer face.

23. The card table topper of claim 22 wherein said track is configured to demonstrate a minimum height adjacent to the inner face and a maximum height adjacent to the outer face thereof.

24. The card table topper of claim 23 wherein the inner face of said card server track is disposed at an angle of from about 5 degrees to about 45 degrees in relation to the flat planar top surface of the topper.

25. The card table of claim 22 wherein the outer face of the card server track is a flat planar.

26. The card table of claim 25 wherein the outer face is disposed at an angle of from about 60 to about 90 degrees in relation to the top planar surface of the topper.

27. The card table of claim 22 wherein the outer face of said card server track is shaped and configured as a curved plane having a radius.

28. The card table of claim 27 wherein said curved plane forms a radius of from about 60 to about 90 degrees.

29. The topper of claim 21 wherein the table topper and track are formed of one material and wherein the track is formed as a continuous and integral part of said topper.

30. The topper of claim 29 wherein said topper and track are formed from a material selected from the group including wood, plastic and composite materials.

31. The table topper 30 wherein the top surface of said table topper and the track are covered by a felt material selected from the group including natural felt, artificial felt and natural/artificial felt.

32. The table topper of claim 30 wherein the topper and track are covered with a material selected from the group comprising natural and artificial rubber materials.

33. The topper of claim 21 wherein the topper and server track are separately formed and fabricated and a means is utilized thereafter to affix the server track to the top surface of the topper.

34. The topper of claim 33 wherein said topper and track are formed from a material selected from the group including wood, plastic and composite materials.

35. The topper top of claim 34 wherein the top surface of said topper and the track are covered by a felt material selected from the group including natural felt, artificial felt and natural/artificial felt.

36. The topper top of claim 34 wherein said top surface of the topper and the track are covered with a material selected from the group comprising natural and artificial rubber materials.

37. The topper of claim 33 wherein the means utilized to affix the server track to the top surface of the topper is selected from the group including bonding, cementation, metal fasteners, plastic fasteners and composite fasteners.

* * * * *